US010017229B2

(12) United States Patent
Ziaylek et al.

(10) Patent No.: US 10,017,229 B2
(45) Date of Patent: Jul. 10, 2018

(54) MARINE CARGO LOADER AND HANDRAIL APPARATUS

(71) Applicant: Michael P. Ziaylek, Yardley, PA (US)

(72) Inventors: Michael P. Ziaylek, Yardley, PA (US); W. Brian McGinty, Huntingdon Valley, PA (US); James Jarozynski, Collingswood, NJ (US)

(73) Assignee: Michael P. Ziaylek, Yardley, PA (US)

( * ) Notice: Subject to any disclaimer, the term of this patent is extended or adjusted under 35 U.S.C. 154(b) by 0 days.

(21) Appl. No.: 15/707,326

(22) Filed: Sep. 18, 2017

(65) Prior Publication Data

US 2018/0079472 A1 Mar. 22, 2018

Related U.S. Application Data

(60) Provisional application No. 62/395,897, filed on Sep. 16, 2016.

(51) Int. Cl.

| | |
|---|---|
| ***B63B 27/16*** | (2006.01) |
| ***B63B 25/00*** | (2006.01) |
| ***B63B 27/00*** | (2006.01) |
| ***B66C 1/62*** | (2006.01) |
| *B66F 9/18* | (2006.01) |

(52) U.S. Cl.

CPC ..... *B63B 27/16* (2013.01); *B63B 25/004* (2013.01); *B63B 27/02* (2013.01); *B66C 1/62* (2013.01); *B66F 9/186* (2013.01)

(58) Field of Classification Search

CPC ..... B63B 27/143; D06F 57/04

USPC ..... 211/111; 248/594

See application file for complete search history.

(56) References Cited

U.S. PATENT DOCUMENTS

| | | | | |
|---|---|---|---|---|
| 2,702,678 | A | 2/1955 | Flock | |
| 3,008,158 | A * | 11/1961 | Stinson | B65G 67/00 114/230.13 |
| 3,426,719 | A * | 2/1969 | Mizell | B63B 27/143 14/71.1 |
| 3,495,729 | A | 2/1970 | Kruse | |
| 3,866,776 | A | 2/1975 | Partyka | |
| 4,003,473 | A * | 1/1977 | Ryan | B63B 21/00 14/71.7 |
| 4,884,938 | A | 12/1989 | Fujita et al. | |
| 5,346,355 | A | 9/1994 | Riemer | |
| 5,601,274 | A * | 2/1997 | Minor | F16F 13/00 248/219.1 |
| 6,202,964 | B1 * | 3/2001 | Thornhill | A01M 31/02 248/219.4 |
| 6,428,263 | B1 | 8/2002 | Schellens | |
| 7,516,712 | B1 * | 4/2009 | O'Dea | B63B 21/00 114/122 |
| 8,322,580 | B1 | 12/2012 | Hamilton | |

(Continued)

*Primary Examiner* — Jonathan D Snelting

(74) *Attorney, Agent, or Firm* — Fox Rothschild LLP; Robert J. Sacco; Carol E. Thorstad-Forsyth

(57) ABSTRACT

A marine cargo loader and handrail device includes a base plate, a post and a platform that is pivotally mounted to the post to allow the platform to move upward and downward. The platform can have two positions, the stored and deployed positions. When stored, the platform is in an upright position. When deployed, the platform is in a substantially horizontal plane with respect to the post. The device may also include a gas dampener to allow for a smooth descent from the stored position downward to the deployed position.

2 Claims, 3 Drawing Sheets

(56) References Cited

U.S. PATENT DOCUMENTS

| | | | | |
|---|---|---|---|---|
| 8,894,342 | B1 * | 11/2014 | Masciana | E01D 15/24 114/362 |
| 9,051,680 | B1 * | 6/2015 | Harris | D06F 53/045 |
| 2006/0182581 | A1 | 8/2006 | Murray et al. | |
| 2008/0317571 | A1 | 12/2008 | Cheatham, Jr. | |
| 2011/0170996 | A1 | 7/2011 | Vrijens | |

* cited by examiner

MARINE CARGO LOADER AND HANDRAIL APPARATUS

CROSS-REFERENCE TO RELATED APPLICATIONS

This application claims priority to U.S. Provisional Application No. 62/395,897, filed Sep. 16, 2016, the disclosure of which is incorporated herein by referenced.

FIELD OF THE INVENTION

This disclosure relates to appliances for docks and particularly to marine/dock cargo loader and handrail for helping people disembark or board their boats while at a dock.

BACKGROUND

Most docks today are not equipped with cargo assist devices to help users to load or unload cargo from a boat. For example, loading a cargo onto a boat may require a person to lift the cargo onto a boat while standing on the edge of the dock and leaning towards the boat. This creates a dangerous situation because the user may lose balance while carrying the cargo and thus may fall into the water between the dock and the boat. In other situations, loading a cargo onto a boat may require two persons: one on the dock to hand the cargo and another on the boat to receive the cargo. Unloading a cargo may also present similar problems and issues.

This disclosure describes devices and systems that are intended to address at least some issues discussed above and/or other issues.

SUMMARY

A dock cargo assist device includes a base plate installable on a surface of a dock, a post extending perpendicularly from the base plate; and a platform. The platform is pivotally mounted to a top portion of the post and can rotate upward or downward to reach a stored position and a deployed position, respectively. The platform also includes a gas dampener that is pivotally attached to the platform at one end and a middle portion of the post at the other end. The gas dampener is configured to extend when the platform is at the stored position and retract when the platform is at the deployed position. At the deployed position, the dampener is disposed diagonally at an angle to function as a support for the platform.

The platform of the device may include a U-shaped frame and a cross bar connecting two arms of the U-shaped frame to add stability to the frame. The platform may further include a hinge that extends through two opposing walls of the post horizontally at the top portion of the post and connects the two ends of the U-shaped frame so that the frame can pivotally move upward and downward about the hinge.

When stored, the platform is in a substantially horizontal plane with respect to the post, with slight elevation at the front portion of the platform that is distal from the post. When deployed, the platform is upward and in a near vertical plane with respect to the post. The device may further include a hooking ring mounted on the platform at a distal point from the post for hooking a lanyard that allows a user to pull the platform from the deployed position downward to the stored position.

DETAILED DESCRIPTION

This disclosure is not limited to the particular systems, methodologies or protocols described, as these may vary. The terminology used in this description is for the purpose of describing the particular versions or embodiments only, and is not intended to limit the scope.

As used in this document, any word in singular form, along with the singular forms "a," "an" and "the," include the plural reference unless the context clearly dictates otherwise. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to."

Figure 1:
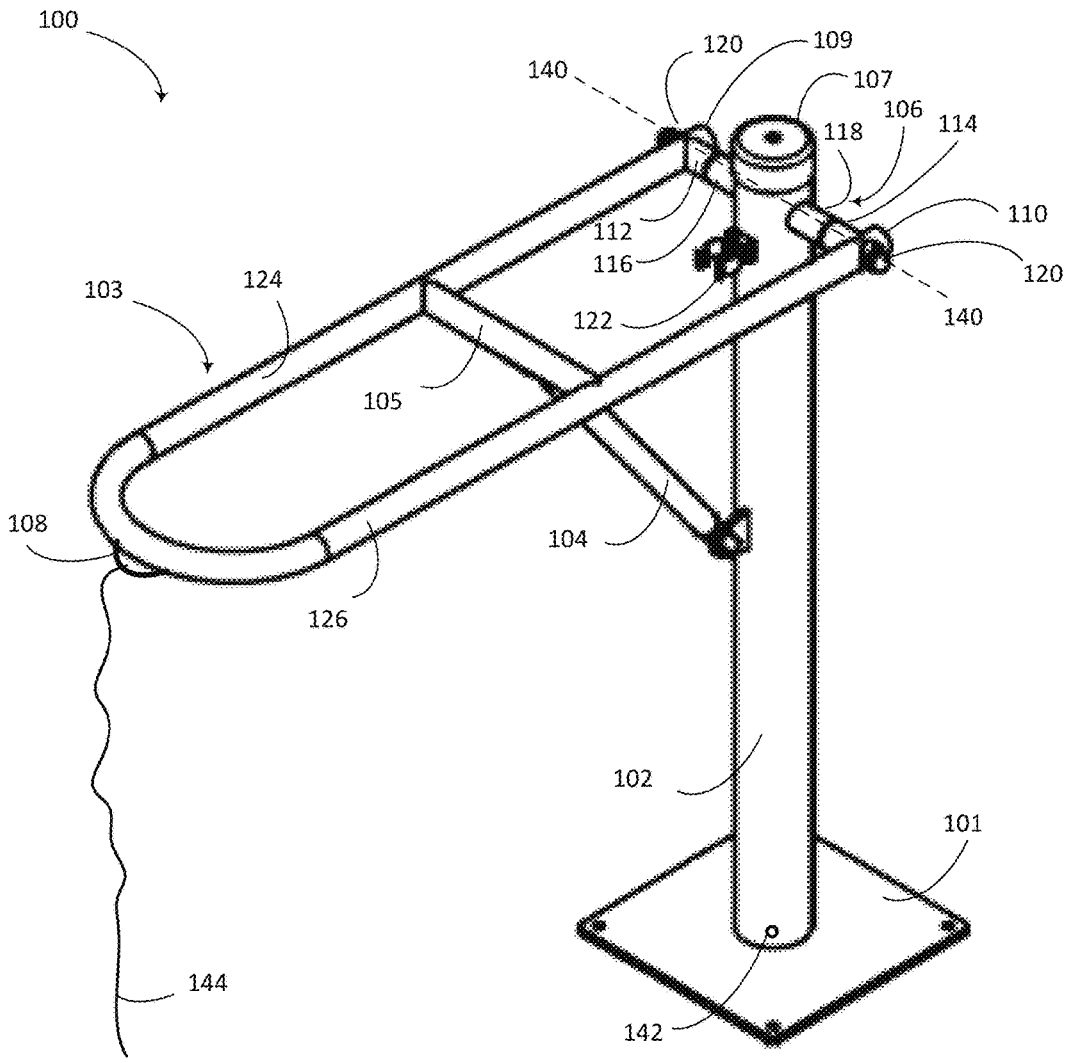
FIG. 1 depicts an example of a dock cargo assist and handrail according to a preferred embodiment.

With reference to FIG. 1, in a preferred embodiment, a marine cargo loader and handrail device 100 includes a base plate 101 installable on a surface of a dock, and a post 102 fixedly mounted to the base plate. For example, the post 102 may be welded or bolted to the base plate 101. The post 102 extends from the base plate 101 perpendicularly from the plane of the base plate. For example, when the base plate is installed on a horizontal dock floor (150 in FIG. 2), the post 102 extends perpendicularly from the base plate 101 so that it is in a near vertical plane. The device 100 also includes a platform 103 pivotally mounted to a top portion of the post 102 and configured to rotate upward or downward to reach a stored position or a deployed position. The device also includes a gas dampener 104, where the gas dampener has two ends: the first end is pivotally attached to the platform 103 and the second end is pivotally attached to a middle portion of the post 102.

Figure 2:
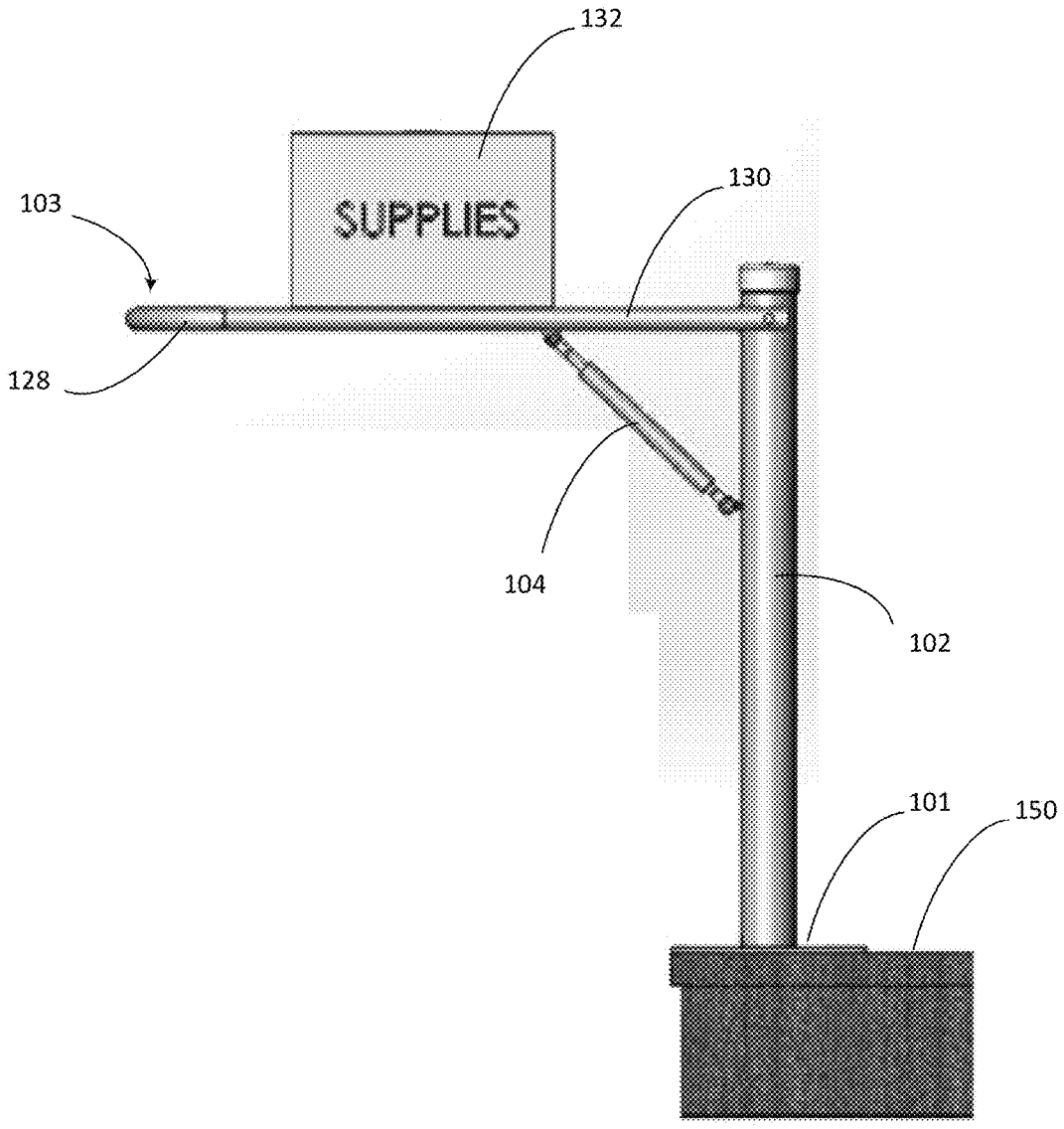
FIG. 2 depicts the cargo assist and handrail in FIG. 1 in a deployed position.

In FIG. 2, the deployed position of the platform 103 is in a substantially horizontal plane with respect to the post, with the distal portion 128 of the platform that is away from the post 102 slightly elevated upward so that the distal portion 128 of the platform is slightly higher than a portion 130 of the platform proximate to the post. This position insures that cargo 132 does not slide forward unintentionally. When the platform 103 is at its deployed position, the gas dampener 104 is retracted and is disposed diagonally at an angle to function as a support for the platform.

Figure 3:
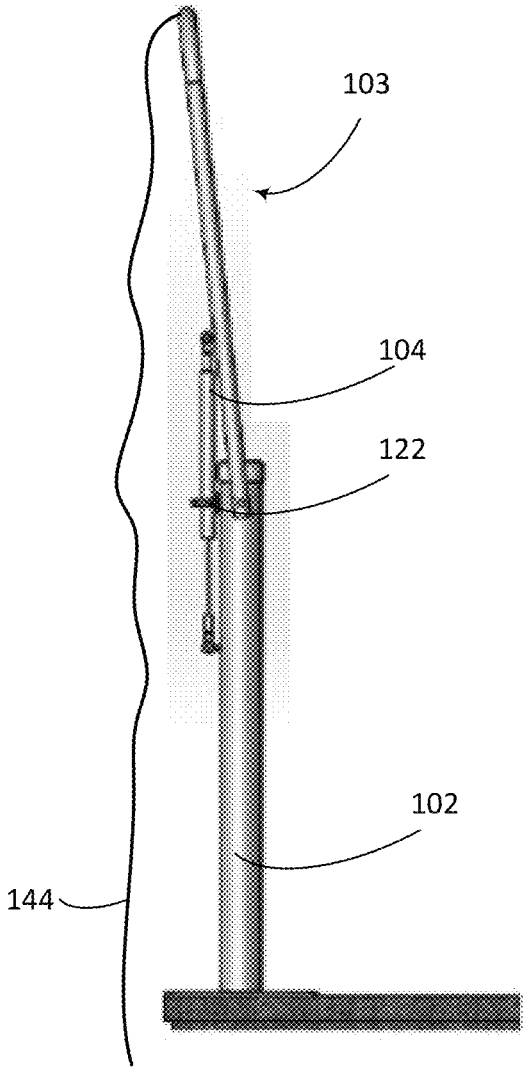
FIG. 3 depicts the cargo assist and handrail in FIG. 1 in a stored position.

In FIG. 3, the stored position of the platform 103 is upward in a near vertical plane with respect to the post. When the platform 103 is in its stored position, the gas dampener 104 is extended and disposed in an upright position. When the platform 103 moves from its stored position to the deployed position, the dampener 104 slows the descent of the platform 103 to prevent striking of the occupant. Optionally, the device may also include a hoop 122 that is mounted to the post and positioned to hold the dampener 104 to the post 102 so that the platform 103 is secured in its stored position. The hoop 122 may be made of elastic material. For example, returning to FIG. 1, the hoop 122 may be a spring clamp that has an opening positioned to receive and secure the dampener 104 in position when the platform 103 moves from the deployed position upwardly to the stored position.

With further reference to FIG. 1, the platform 103 may include a U-shaped frame that has two arms 124 and 126, and a cross bar 105 connecting the two arms of the U-shaped frame in a middle portion of each arm. Each arm 124, 126 of the U-shaped frame has a free end 109, 110. The cross bar 105 adds stability to the platform 103 when it is used in the deployed position. The platform further includes a hinge 106 that extends from two opposing walls of the post horizontally at the top portion of the post 102 and connects the two free ends of the U-shaped frame 109, 110 so that the frame pivotally moves upward and downward about the hinge 106.

In the illustrated embodiment, the hinge may include a first arm 116 and a second arm 118, each arm is attached to the post and respectively extending perpendicularly from one of the opposing walls of the post outwardly. Each arm may be attached to the post via various means. For example, each arm may be hollow and attached to the post via a bolt that extends through both arms 116, 118 and the two opposing walls of the post 102 to hold the two arms 116, 118 to the post. Alternatively, each of the arms 116, 118 may be fixedly attached to the post 102. For example, each of the arms 116, 118 may be welded to the post 102.

With further reference to FIG. 1, the hinge may additionally include a third arm 112 and a fourth arm 114, each respectively attaching to the free end of each arm 124, 126 of the U-shaped frame 109, 110 and extending perpendicularly from each arm towards the post 102. The third and fourth arms 112, 114 may be pivotally coupled to the first and second arm 116, 118, respectively. For example, all of the first, second, third and fourth arms 112, 116, 118, 114 may each be hollow and they may be pin/hinge joined through a bolt that extends through all of the arms and the post 102 along a center line 140 and attaches to the free end of each arm of the U-shaped frame 109, 110 by a nut 120. In such a way, the first and third arms 116, 112 are coupled and configured to rotate relative to each other about the center line 140; and the second and fourth arms 118, 114 are coupled and configured to rotate relative to each other about the center line 140.

Alternatively, and/or additionally, the first and third arms 116, 112 may also be coupled via a pin/hinge joint that joins both arms and allows the arms to move in one degree of freedom so that they are rotatable relative to each other about the center line 140. The second and fourth arms 118, 114 may also be coupled via a pin/hinge that joins both arms and allows them to rotate relative to each other about the center line 140.

The device may further include a cap 107 covering the top of the post. The device may also include one or more draining holes 142 near the bottom end of the post 102 to prevent moisture from accumulating inside the post. The device may also include a hooking ring 108 mounted on the platform at a distal point from the post for hooking a lanyard 144 that allows a user to pull the platform to cause the platform to move from the stored position downward to the deployed position. The lanyard may be long enough so that when the platform is in its stored position, the lanyard can be tied to the middle or bottom portion of the post. This allows a person to be able to reach the lanyard from the boat (see FIG. 3) when docking and pull the lanyard to cause the platform to move download from its stored position to the deployed position. The hoop 122 that secures the gas dampener 104 to the post 102 is configured so that a slight force from the pull of the lanyard may cause the gas dampener to be released from the hoop.

The device may have various sizes. For example, the height of the post can be designed such that the cargo can be loaded comfortably from the dock and unloaded comfortably from the boat. The height may also depend on the height of the boat. Additionally, the size and shape of the platform may vary to suit different applications that may require different sizes and shapes of cargo containers. Additionally, the base plate may be extended to a larger size to allow for better mechanical advantage to loading. Additionally, the shape and diameter of the post may vary depending on the application and expected weight of the cargo. Alternatively and/or additionally, the materials for the device may be made of, but not limited to: polished stainless steel, anodized aluminum and powder coated aluminum.

The device disclosed above can be suitable for loading or unloading supplies to/from a boat. The disclosed device can also be suitable for assisting a passenger to embark or disembark from a boat. For example, when a passenger embarks or disembarks, the platform may be set at the deployed position, and the passenger may grab the platform of the device to aid the embarking or disembarking.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A marine cargo loader apparatus, comprising:

a base plate installable on a surface of a dock;

a post fixedly mounted to the base plate and extending from the base plate perpendicular to a plane of the base plate;

a platform pivotally mounted to a top portion of the post and configured to rotate upward or downward to reach a stored position or a deployed position;

a dampener having a first end and a second end, the first end pivotally attaching to the platform and the second end pivotally attaching to a middle portion of the post, wherein the dampener is configured to extend when the platform is at the stored position and retract when the platform is at the deployed position;

a cap covering a top of the post;

a hooking ring mounted on the platform at a point distal from the post for hooking a lanyard that allows a user to pull the platform to cause the platform to move from the stored position downward to the deployed position;

a hoop mounted to the post and configured to hold the dampener to the post so that the platform is secured in its stored position;

wherein the platform comprises:

a U-shaped frame having two arms, each arm having a free end;

a cross bar connecting the two arms of the U-shaped frame in a middle portion of each arm; and a hinge extending through two opposing walls of the post at the top portion of the post and connecting the free end of each arm of the U-shaped frame so that the U-shaped frame pivotally moves upward and downward about the hinge;

wherein the deployed position of the platform is in a substantially horizontal plane with respect to the post, with a distal portion of the platform away from the post slightly elevated upward so that the distal portion is slightly higher than a portion of the platform proximate to the post;

wherein the stored position of the platform is upward and in a near vertical plane with respect to the post;

wherein the hinge is connected to the free end of each arm of the U-shaped frame by a bolt;

wherein the hinge comprises:

a first and second arm, each attaching to one of the opposing walls of the post respectively and extending perpendicularly from the post outwardly; and a third and fourth arm, each respectively attaching to the free end of each arm of the U-shaped frame and extending perpendicularly towards the post, wherein the third and fourth arm are hinge joined to the first and second arm, respectively; and wherein the hoop is a spring clamp having an opening positioned to receive the dampener when the platform is rotated to its stored position.

2. A marine cargo loader apparatus of claim 1 wherein the post is welded or bolted to the base plate.

* * * * *